United States Patent [19]

Omdal

[11] 4,269,247

[45] May 26, 1981

[54] LARGE SIZE SACK AND METHODS FOR THE FORMATION THEREOF

[75] Inventor: Bjarne Omdal, Porsgrunn, Norway

[73] Assignee: Norsk Hydro a.s., Oslo, Norway

[21] Appl. No.: 15,181

[22] Filed: Feb. 26, 1979

Related U.S. Application Data

[63] Continuation of Ser. No. 659,185, Feb. 18, 1976, abandoned.

[51] Int. Cl.[3] ..... B65D 30/02; B65D 33/06

[52] U.S. Cl. ..... 150/12; 229/54 R; 229/55; 493/223; 493/926

[58] Field of Search ..... 229/54 R, 55; 150/1, 150/12; 93/35 H, 8 UB

[56] References Cited

U.S. PATENT DOCUMENTS

| | | | |
|---|---|---|---|
| 3,325,082 | 6/1967 | Naylor | 229/55 |
| 3,340,919 | 9/1967 | Holbrook | 150/1 |
| 3,470,928 | 10/1969 | Schwartz | 150/1 |

FOREIGN PATENT DOCUMENTS

| | | | |
|---|---|---|---|
| 102164 | 7/1965 | Denmark | 229/54 R |
| 1259473 | 1/1972 | United Kingdom | 229/54 R |

*Primary Examiner*—Stephen P. Garbo

*Attorney, Agent, or Firm*—Wenderoth, Lind & Ponack

[57] ABSTRACT

A single piece of woven material is folded in half along a fold line forming a sack top. Bottom free edges are sewn to form a bottom seam. Side free edges are sewn to form side seams which are spaced from the fold line. A single slit is formed from the fold line between the side edges. The slit does not cut lengthwise extending strips of the woven material, such that upon lifting the sack by lifting loops between the slit and the side edges, the lifting stress is evenly distributed among all of the lengthwise strips.

5 Claims, 7 Drawing Figures

LARGE SIZE SACK AND METHODS FOR THE FORMATION THEREOF

This is a continuation of application Ser. No. 659,185, filed Feb. 18, 1976, now abandoned.

BACKGROUND OF THE INVENTION

The present invention relates to an improvement in sacks for the storage and transport of bulk goods, for example, road salt and artificial fertilizer for forrestry and agricultural usage.

Due to the constantly increasing costs of labor, attempts have been made in all fields to avoid manual handling of bulk goods to the greatest possible extent. With regard to artificial fertilizer, for example, attempts are made to avoid the use of units of 25 to 50 kg which are handled manually when a fertilizer spreader, which may have a capacity of a ton, is to be filled, and many experiments have been made in the attempt to provide sacks which can be filled with several hundred kg and even tons of material to be transported or stored, and which can be handled more rationally than smaller units.

However, such previously developed sacks have created more problems than they have solved. Even with the five-fold and seven-fold safety measures which are required throughout the world, with the use of such known sacks, uneven distribution of stress and strain when such sack is hoisted can lead to rupturing of the sack and the resultant safety hazard and discharge of the contents at an undesired location, with subsequent trouble and consumption of time and labor for collection, if collection is at all possible.

These known types of sacks which have a capacity of from several hundred kilograms to tons, and preferably up to 1000 kilograms, and which are usually called "large-size sacks" or "intermediate bulk containers," therefore, have been based on various ideas. One type of sack has two parallel runners at two opposing edges of the opening for suspension on a forklift support. Another known type is provided with lifting straps which are attached to the exterior of the sack. However, in addition to the expense of this embodiment, there is little to ensure that the straps will remain so precisely in place that the lifting forces will be uniformly distributed and will not be concentrated in smaller areas where they can lead to strains which exceed the tearing strength of the material. Large size sacks have also been effected in a conventional manner and in the form of a conventional sack which is manually lashed around a rod or other lifting member. Since it involves manual work, the lashing varies from sack to sack with consequent variations in the distribution of strains. It is of course possible to produce sacks which, with a great degree of safety, can contain several tons if necessary. However, an additional requirement of such sacks is that they must be inexpensive enough to be disposed of after a single use. Several of the above known types of sacks are so expensive that they must be used repeatedly, and the problem and cost of returning the sacks then arise, and it is possible that they must be reconditioned before they can be refilled.

During the development of the sack according to the present invention, scale up of bags of the type described in U.S. Pat. No. 3,358,904 was also considered. However, it was soon realized that neither the design nor the material or production methods of such bags could be adapted to the large size sack in question. Mere scale up of such bags would give sacks that not only would lack the necessary strength, but would also be unsuitable in other respects.

SUMMARY OF THE INVENTION

In accordance with the present invention there is provided a sack produced from a single piece of woven material which is folded double, whereby a folded edge is produced. The filling opening of the sack is located at such folded edge, and the free edges of the material are secured together by sewing to form seams. The material in the folded edge on either side of the filling opening is thus an uninterrupted piece of material without score lines, and the sack can be carried by this material in that the side edges are provided with openings at the ends adjacent the folded edge. The sack is very simple to produce from, for example, woven polypropylene textile material which is laid double and sewn around the free edges on already existing machines, the filling opening being formed by a single slit inwardly from the folded or unsewn edge. The sack is then provided with a sewn bottom. This causes no problems and, by terminating the seams at a distance from the folded edge, the openings necessary for formation of lifting loops when the sack is later lashed are provided. When such a sack is lashed, the material on either side of the filling opening forms two adjacent loops by which the sack can be lifted. Since the loops are integral with and identical to the material in the remainder of the sack, a natural and uniform distribution of the stretch strains in the material of the sack is ensured, whereby an economical utilization of the sack is obtained even with high safety requirements. More particularly, the woven material includes interwoven lengthwise strips extending transverse to the folded edge and transverse strips extending parallel to the folded edge. The filling opening is formed by a single slit which does not cut the lengthwise strips. Upon lifting the sack, the lifting strains on the sack are carried by the lengthwise strips, and are thus evenly distributed among all of the lengthwise strips.

The invention also provides a method for filling and closing the sacks in accordance with the invention, and this is effected in a simple manner in that the filling opening which, in the unloaded state, is merely a slit in the sack material, is drawn open in order to fill the sack. Thereafter, the sack may be lashed at a position sufficiently far from the top to close the filling opening, and it is the lashing which automatically leads to the formation of loops of material on either side of the filling opening.

BRIEF DESCRIPTION OF THE DRAWINGS

By way of example, a specific embodiment in accordance with the invention will now be described, with reference to the accompanying drawings, in which.

DETAILED DESCRIPTION OF THE INVENTION

Figure 1:
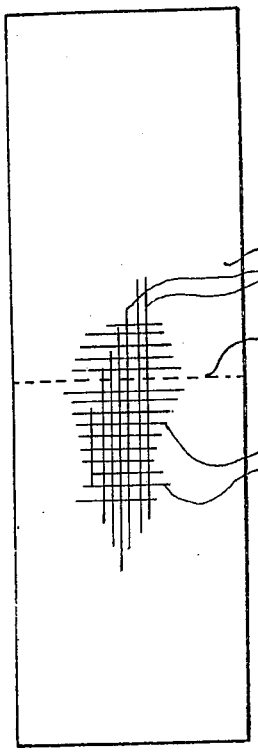
FIG. 1 is a schematic view of a single sheet of woven material employed in the formation of a large size sack according to the invention.
Figure 2:
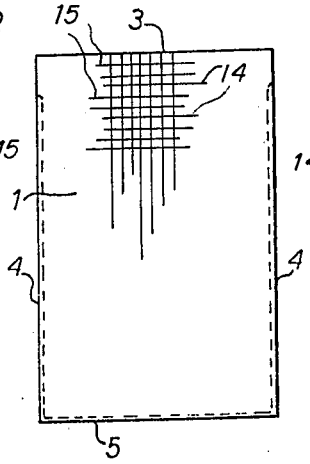
FIG. 2 is a schematic view showing the sheet folded and sewn to form a large size sack.
Figure 3:
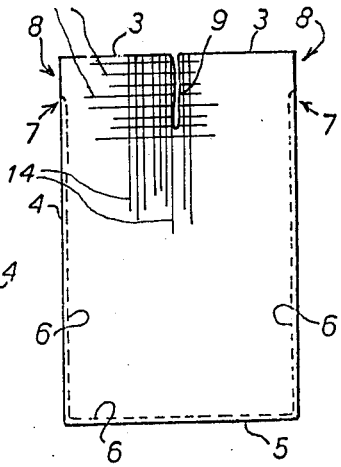
FIG. 3 is a schematic view showing the large size sack slit to form a filling opening and lifting loops.

FIG. 1 illustrates a single piece of woven material 1, for example, woven polypropylene textile material, and this piece is folded along a center line 2. It then has the shape illustrated in FIG. 2 with a folded edge 3 at the top and free edges 4 and 5. The free edges 4 and 5 are, in the example illustrated, sewn together to form seams 6 so that the sack is formed. The seams 6 on both sides terminate at the arrow 7 so that above such seams openings 8 are produced. The filling opening, as shown in FIG. 3, is provided by a slit 9 through both layers of the material and directed lengthwise of the sack from the folded edge 3.

Figure 4:
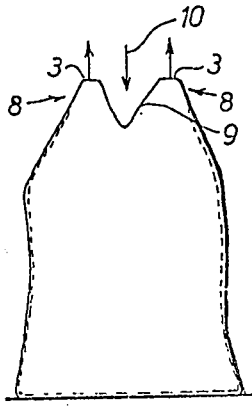
FIG. 4 is a schematic view showing the large size sack suspended during filling according to the invention.
Figure 5:
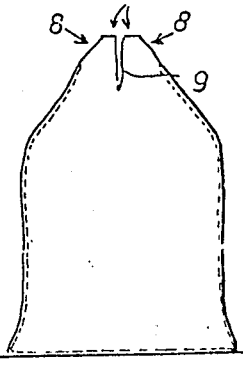
FIG. 5 is a schematic view showing the filling opening bent drawn together after filling.

When the sack is filled, it is disposed on a base layer and suspended, as illustrated in FIG. 4, so that the slit 9 opens and the sack can be filled therethrough as indicated by the arrow 10. During the filling operation, the sack may be suspended in any expedient manner and, subsequent to filling, it stands by itself on the base layer and the upper part is drawn together as illustrated in FIG. 5.

Figure 7:
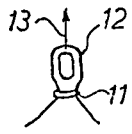
FIG. 7 is a detail view showing the lifting loops of the lashed filled sack.
Figure 6:
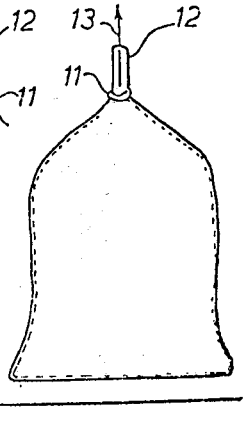
FIG. 6 is a schematic view showing the filled sack lashed together and lifted according to the invention.

The sack is now lashed around the upper end thereof by knotting a rope 11 sufficiently far down from the top such that the slit 9 is closed and such that, above the rope 11 (FIGS. 6 and 7), two adjacent loops 12 are formed from the parts of the material of the sack located on either side of the slit 9, and including the openings 8.

The sack can now be hoisted in the direction 13 by means of the loops 12 for transport. The distribution of force is uniform since the material in the sack and in the loops is the same, and there will be no variation from sack to sack. Thus, material piece 1 is formed of interwoven lengthwise strips 14 and transverse strips 15. Slit 9 does not cut any, or substantially any, of the lengthwise strips 14. During lifting of the sack (FIG. 7), the lifting stress and strain will be carried by the lengthwise strips 14. Thus, during lifting the total stress will be evenly distributed among all of the lengthwise strips 14. The provision of the filling opening and the lifting loops according to the invention does not weaken the upper part of the sack with respect to strength against vertical lifting stresses and strains. The sack is further so inexpensive that it can be disposed of after a single use.

The example illustrated serves merely to explain the invention and forms no restriction on the scope of the present invention, since other embodiments may well be envisaged which are within the scope of the invention. The sack may comprise one or more layers and have an inner sack which is closed per se when necessary. The outer sack which actually carries the weight, can be made from a textile of fibrous material e.g. woven polypropylene or the like. The inner sack can be made from a cheap and not necessarily strong material as polyethylene, paper or the like. Furthermore, in place of the simple embodiment illustrated in the drawings, the sack may be provided with insertions in the sides thereof when desired.

As an alternative or complementary device to the application of the above mentioned inner sack, the same may be provided with an inner lid made of plastic sheeting or woven material. The lid is fastened to the inside of the sack and may have the form of a hose with the same diameter as the sack. The lid may also comprise a circular or cone formed sheet extending in a neck of suitable diameter. The lid is closed by lashing. When filling the sack, the lid's neck is connected to the filling tube and the sack can be blown up with air before filling.

What I claim is:

1. A large size sack for the transport, lifting and storage of large quantities of free-flowing bulk materials, said large size sack comprising:

a single piece of woven material formed of woven lengthwise strips and transverse strips;

said single piece of woven material being folded in half along a fold line extending transverse to said lengthwise strips, thus forming a sack top at said fold line and two overlapped sack panels having adjacent sack bottom edges extending parallel to said fold line and parallel adjacent sack side edges extending transverse to said fold line between opposite ends of said bottom edges and said fold line;

said adjacent sack bottom edges being closed to form a closed sack bottom;

said adjacent sack side edges being sewn together from said sack bottom to positions spaced from said fold line to form two sack side seams, said side seams being spaced from said fold line to define therebetween two side openings;

said sack panels having therein, at a location between said side edges thereof, a single longitudinal slit extending perpendicularly from said fold line and parallel to said side edges, said slit forming a sack filling opening;

portions of said sack panels between said slit and said two side openings forming two lifting loops for lifting the sack, said lifting loops comprising unbroken integral elongations of said woven material of said sack panels;

substantially all of said lengthwise strips of said woven material being continuous and unbroken by said slit, such that upon lifting the sack by said lifting loops, the critical stress along said lengthwise strips from said fold line to said sack bottom is evenly distributed among all of said lengthwise strips; and said woven material having a sufficient size and strength such that the sack can be filled with a quantity of free-flowing bulk material of a weight of from several hundred kilograms to several tons without rupture of said material when the thus filled sack is lifted by said lifting loops.

2. A sack as claimed in claim 1, wherein said woven material comprises woven polypropylene textile material.

3. A sack as claimed in claim 1, further comprising means for, after the sack is filled, lashing the sack around said side seams and said sack panels thereof, at a position sufficiently spaced from said fold line such that said side openings remain open and said filling opening is closed and isolated from the interior of the sack.

4. A method for forming a large size sack for the transport, lifting and storage of large quantities of free-flowing bulk materials, said method comprising:

providing a single piece of woven material formed of woven lengthwise strips and transverse strips;

folding said single piece of material in half along a fold line extending transverse to said lengthwise strips, and thereby forming a sack top at said fold line and two overlapped sack panels having adjacent sack bottom edges extending parallel to said fold line and parallel adjacent sack side edges extending transverse to said fold line between opposite ends of said bottom edges and said fold line;

closing said bottom edges and thereby forming a closed sack bottom;

sewing said adjacent sack side edges together from said sack bottom to positions spaced from said fold line, thereby forming two sack side seams spaced from said fold line, and thereby forming two side openings between said two sack side seams and said fold line;

forming a filling opening in said sack by cutting in said sack panels, at a location between said side edges thereof, a single longitudinal slit extending perpendicularly from said fold line and parallel to said side edges, thereby forming two lifting loops of portions of said sack panels between said slit and said two side openings, said portions forming said lifting loops being unbroken integral elongations of said woven material of said sack panels, and said slit being formed without cutting substantially any of said lengthwise strips, thereby maintaining substantially all of said lengthwise strips continuous and unbroken, such that upon lifting said sack by said lifting loops, the critical stress along said lengthwise strips from said fold line to said sack bottom is evenly distributed among all of said lengthwise strips; and providing said woven material of a sufficient size and strength such that said sack can be filled with a quantity of free-flowing bulk material of a weight of from several hundred kilograms to several tons without rupture of said material when the thus filled sack is lifted by said lifting loops.

5. A method as claimed in claim 4, wherein said woven material is woven polypropylene textile material.

* * * * *